US010422535B2

(12) United States Patent
Knapp et al.

(10) Patent No.: US 10,422,535 B2
(45) Date of Patent: Sep. 24, 2019

(54) CAN COMBUSTOR FOR A CAN-ANNULAR COMBUSTOR ARRANGEMENT IN A GAS TURBINE

(71) Applicant: ALSTOM Technology Ltd, Baden (CH)

(72) Inventors: Klaus Knapp, Gebensdorf (CH); Naresh Aluri, Ennetturgi (CH); Nicolas Tran, Zurich (CH); Ulrich Rathmann, Baden (CH); Franklin Marie Genin, Baden (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 899 days.

(21) Appl. No.: 14/260,617

(22) Filed: Apr. 24, 2014

(65) Prior Publication Data

US 2014/0318135 A1 Oct. 30, 2014

(30) Foreign Application Priority Data

Apr. 26, 2013 (EP) ..... 13165488

(51) Int. Cl.
*F23R 3/28* (2006.01)
*F23R 3/14* (2006.01)
(Continued)

(52) U.S. Cl.
CPC ..... *F23R 3/286* (2013.01); *F23R 3/14* (2013.01); *F23R 3/34* (2013.01); *F23R 3/46* (2013.01); *F23C 2900/07002* (2013.01)

(58) Field of Classification Search
CPC .... F23R 3/286; F23R 3/14; F23R 3/34; F23R 3/46; F23R 2900/00014; F23C 2900/07002
(Continued)

(56) References Cited

U.S. PATENT DOCUMENTS 3,811,274 A 5/1974 Calderon
5,454,220 A * 10/1995 Althaus ..... F02C 6/003 60/39.17
(Continued)

FOREIGN PATENT DOCUMENTS

CN 2200120 Y 6/1995
CN 1601181 A 3/2005
(Continued)

OTHER PUBLICATIONS

Office Action (First Office Action) dated Aug. 28, 2015, by the State Intellectual Property Office of the People's Republic of China in corresponding Chinese Patent Application No. 201410169977.6, and an English Translation of the Office Action. (25 pages).
(Continued)

*Primary Examiner* — Ted Kim
(74) *Attorney, Agent, or Firm* — Buchanan Ingersoll & Rooney PC

(57) ABSTRACT

The invention relates to a can-combustor for a can-annular combustor arrangement in a gas turbine. The can combustor includes an essentially cylindrical casing with an axially upstream front panel and an axially downstream outlet end. The can combustor further includes a number of premixed burners, extending in an upstream direction from said front panel and having a burner exit, supported by this front panel, for supplying a fuel/air mixture into a combustion zone inside the casing. Up to four premixed burners are attached to the front panel in a substantially annular array. Each burner has a conical swirl generator and a mixing tube to induce a swirl flow of said fuel/air mixture.

25 Claims, 7 Drawing Sheets

(51) Int. Cl.
*F23R 3/34* (2006.01)
*F23R 3/46* (2006.01)

(58) Field of Classification Search
USPC ..... 60/737, 748, 725
See application file for complete search history.

(56) References Cited

U.S. PATENT DOCUMENTS

| | | | | |
|---|---|---|---|---|
| 5,735,687 | A * | 4/1998 | Knopfel | F23C 7/002 431/115 |
| 5,983,643 | A | 11/1999 | Kiesow | |
| 6,052,986 | A * | 4/2000 | Hoffmann | F23D 23/00 431/114 |
| 6,430,930 | B1 | 8/2002 | Andersson | |
| 6,769,903 | B2 | 8/2004 | Eroglu et al. | |
| 6,772,594 | B2 | 8/2004 | Nishida et al. | |
| 6,889,495 | B2 * | 5/2005 | Hayashi | F23D 14/70 60/39.37 |
| 6,915,637 | B2 | 7/2005 | Nishida et al. | |
| 6,968,693 | B2 | 11/2005 | Colibaba-Evulet et al. | |
| 7,055,331 | B2 | 6/2006 | Graf et al. | |
| 7,171,813 | B2 | 2/2007 | Tanaka et al. | |
| 7,260,935 | B2 | 8/2007 | Colibaba-Evulet et al. | |
| 7,491,056 | B2 | 2/2009 | Knoepfel | |
| 7,886,545 | B2 * | 2/2011 | Lacy | F23R 3/286 60/39.37 |
| 8,087,228 | B2 | 1/2012 | McMahan et al. | |
| 2003/0014975 | A1 | 1/2003 | Nishida et al. | |
| 2003/0152880 | A1 | 8/2003 | Eroglu et al. | |
| 2004/0020210 | A1 | 2/2004 | Tanaka et al. | |
| 2004/0163392 | A1 | 8/2004 | Nishida et al. | |
| 2005/0039464 | A1 | 2/2005 | Graf et al. | |
| 2005/0061004 | A1 | 3/2005 | Colibaba-Evulet et al. | |
| 2005/0217276 | A1 | 10/2005 | Colibaba-Evulet et al. | |
| 2007/0202453 | A1 | 8/2007 | Knoepfel | |
| 2008/0032246 | A1 * | 2/2008 | Ruck | F23C 7/002 431/351 |
| 2008/0070176 | A1 * | 3/2008 | Steinbach | F23C 7/002 431/354 |
| 2010/0058766 | A1 | 3/2010 | McMahan et al. | |
| 2010/0192578 | A1 | 8/2010 | Singh et al. | |
| 2010/0297566 | A1 | 11/2010 | Noiray et al. | |
| 2011/0107765 | A1 | 5/2011 | Valeev et al. | |
| 2012/0047907 | A1 * | 3/2012 | Zajadatz | F23D 11/16 60/773 |
| 2014/0007578 | A1 * | 1/2014 | Genin | F23C 6/047 60/737 |
| 2014/0007579 | A1 * | 1/2014 | Ainslie | F23R 3/28 60/746 |

FOREIGN PATENT DOCUMENTS

| | | | |
|---|---|---|---|
| CN | 100529547 | C | 8/2009 |
| CN | 102052158 | A | 5/2011 |
| DE | 196 15 910 | | 10/1997 |
| DE | 10 2007 042 059 | | 3/2008 |
| DE | 10 2010 060 363 | | 5/2011 |
| DE | 10 2011 000 589 | | 8/2011 |
| EP | 0 321 809 | | 6/1989 |
| EP | 0 704 657 | | 4/1996 |
| EP | 0 780 629 | A2 | 6/1997 |
| EP | 1 517 088 | | 3/2005 |
| EP | 2 213 942 | | 8/2010 |
| EP | 2 538 139 | | 12/2012 |
| JP | 2002-522741 | A | 7/2002 |
| JP | 2002-257342 | | 9/2002 |
| JP | 2003-014232 | A | 1/2003 |
| JP | 2003-083541 | A | 3/2003 |
| JP | 2003-262336 | | 9/2003 |
| JP | 2004-507701 | A | 3/2004 |
| JP | 2005-098678 | A | 4/2005 |
| JP | 2006-105534 | A | 4/2006 |
| JP | 2008-519237 | A | 6/2008 |
| JP | 2010065996 | A | 3/2010 |
| JP | 2010-175242 | A | 8/2010 |
| JP | 2011-099444 | A | 5/2011 |
| WO | 98/21527 | | 5/1998 |
| WO | 03/058123 | | 7/2003 |
| WO | 2012/136787 | | 10/2012 |

OTHER PUBLICATIONS

Office Action (Notification of Reasons for Refusal) dated Sep. 28, 2015, by the Japanese Patent Office in corresponding Japanese Patent Application No. 2014-092325, and an English Translation of the Office Action. (22 pages).

Office Action (Text of Third Office Action) dated Nov. 22, 2016, by the Chinese Patent Office in corresponding Chinese Patent Application No. 201410169977.6, and an English Translation of the Office Action. (26 pages).

Office Action (Notice of Final Rejection) dated Jul. 28, 2016, by the Korean Patent Office in corresponding Korean Patent Application No. 10-2014-0049781, and an English Translation of the Office Action. (6 pages).

Office Action (Appeal Decision) dated Jun. 26, 2017, by the Japanese Patent Office in corresponding Japanese Appeal No. 2016-014529, and English Translated of excerpts of the Office Action. (24 pages).

* cited by examiner

CAN COMBUSTOR FOR A CAN-ANNULAR COMBUSTOR ARRANGEMENT IN A GAS TURBINE

CROSS-REFERENCE TO RELATED APPLICATIONS

This application claims priority to European application 13165488.1 filed Apr. 26, 2013, the contents of which are hereby incorporated in its entirety.

TECHNICAL FIELD

The invention relates to a can combustor for a can-annular combustor arrangement in a gas turbine, preferably a heavy-duty gas turbine for a power plant, with low $NO_x$- and CO-emissions.

BACKGROUND

Modern heavy-duty gas turbines are equipped with multi-burner silo-combustors, with annular combustors or with can-annular combustor arrangements.

A can-annular combustor consists of a number of individual can-combustors, annularly arranged in the combustion chamber of the gas turbine. The design of a conventional can-combustor is characterized by having a cylindrical combustor with—at its upstream end—one center burner and more than five burners arranged in an annular pattern equally spaced at a constant radial distance to the central axis of the circular combustor. The center burner can be of different design and can have a different axial exit plane position in relation to the other burners. The center burner often works as a pilot stage featuring part of the fuel being injected in a diffusion flame mode or as a partially premixed pilot.

A combustor of this type is disclosed, for example, in the published patent applications DE 102010060363 or in DE 102011000589.

WO 2012136787 discloses a can-annular combustion system in connection with a heavy-duty gas turbine using the reheat combustion principle.

SUMMARY

It is an object of the present invention to provide a can-combustor for a can-annular combustor arrangement in a gas turbine with an improved operability, serviceability and environmental performance.

One of numerous aspects of the present invention includes a can combustor for a can-annular combustor arrangement in a gas turbine, the can combustor comprising an essentially cylindrical casing with an axially upstream front panel, a number of premixed burners, extending in an upstream direction from said front panel and having a burner exit, supported by this front panel, for supplying a fuel/air mixture into a combustion zone inside the can casing, wherein the number of burners per can is limited to up to four premixed burners that are attached to the front panel in a substantially annular array, and wherein each of said burners has a conical swirl generator and a mixing tube to induce a swirl flow of said fuel/air mixture.

The nonexistence of a central burner and the limitation of the total number of burners to maximally four premixed burners per can provides a significant cost saving potential.

According to another aspect of the invention each of said conical swirl generators comprises at least two axially extending air inlet slots. Premixed burners with a conical swirl generator and with two or more axially extending air inlet slots have been developed by the applicant. These burners are well-known for a person skilled in the art and are described in the European patents 321809 or 704657, for example. Further details about this burner type are disclosed later in this description.

According to a preferred embodiment of this invention the conical swirl generator of at least one burner in the can-combustor comprises four to eight axially extending air inlet slots.

In accordance with another embodiment at least one burner is equipped with a lance, aligned parallel to the central burner axis, for injecting additional fuel either into the swirl generator, into the mixing tube or directly into the combustion zone.

According to a particularly preferred embodiment of this invention at least one, preferably all, burners have a multi-stage fuel supply. The premixed burners have up to three fuel stages, namely one or two premix stages and one pilot stage. Possible configurations of fuel injection are disclosed later.

A multi-stage fuel supply gives additional operational robustness and flexibility keeping low $NO_x$ emissions.

In another aspect the installed premixed burners comprise two burner-groups, wherein a first group induces a swirl flow with a clockwise sense of rotation and a second group induces a swirl flow with an anti-clockwise sense of rotation. At least one burner induces a swirl with a sense of rotation that differs from the swirl rotation of the other burners. In a preferred embodiment, based on a can combustor with four installed premixed burners, it is proposed to provide either two diametrically opposed burners or two adjacent burners with a swirl with the same sense of rotation.

The usage of co-swirl and counter-swirl arrangement significantly supports burner/burner cross-stabilization and gives additional operational robustness. It has been found that counter-flow or co-flow at the aerodynamic interface of adjacent burners result in different flame stability.

Another essential aspect of the invention relates to the arrangement of the premixed burners within the can. In particular, this arrangement has to be done in such a way that the probability to excite thermoacoustic instabilities is reduced.

Various measures in this regard are part of the present invention. The approach is to avoid symmetry planes and to reduce the size of coherent flow structures. According to the invention this is realized by placing the burners on the front panel on different radial distances from its central axis (different perimeters), by inclining the burner axis in radial and/or azimuthal direction and/or by using a conical front panel design. These embodiments are referred in more detail in the dependent claims.

Another approach is to create a broader spectrum of characteristic mixing times of fuel and combustion air. For this reason the invention teaches to provide burners differing in essential parameters, particularly differing in the dimension of certain burner components. According to an aspect of the invention the length and/or the diameter of the mixing tube of at least one burner differs from the length and/or diameter of the mixing tube of at least one other burner. Additionally or alternatively, the geometry of the swirl generator of at least one burner may be different. These measures have an impact to the mass throughput and the mixing time.

The advantages of the gas turbine combustion system according to the present invention are, amongst others, the following:

The gas turbine combustion system has reduced emissions and an improved flame stability at multiload conditions. This is accomplished by complete premixing of the fuel and combustion air in burners with a conical swirl generator and, downstream thereof, an adapted mixing tube.

The burner/burner communication and hence stabilization within the can-combustor can be enhanced by the disclosed measures of burner arrangement and influencing the formation, place and intensity of shear layers by co- and counter-swirl arrangements.

The resulting secondary flow scheme in the vicinity of the burner exit and the residual swirl along the combustor can be used to get optimum operational behaviour and temperature pattern at the turbine inlet.

Arrangements with different burner configurations with the can combustor lead to a wider operating range.

The gas turbine combustion system according to the invention eliminates the arrangement of the common center burner, often acting as a pilot burner. This fact and the limited number of installed premixed burners provides cost saving potential.

The present invention is applicable in can-annular combustor arrangements in reheat or non-reheat gas turbines with low emissions of $NO_x$ and CO.

The compact size allows a design with a limited number of wearing parts and effects a low sensitivity to combustion dynamics.

The can-combustor architecture reduces circumferential temperature gradients at the turbine inlet. This effects the lifetime of turbine parts.

BRIEF DESCRIPTION OF THE DRAWINGS

These and other features, aspects and advantages of the present invention are described in more detail with reference to the accompanying drawings, wherein.

DETAILED DESCRIPTION

Figure 1:
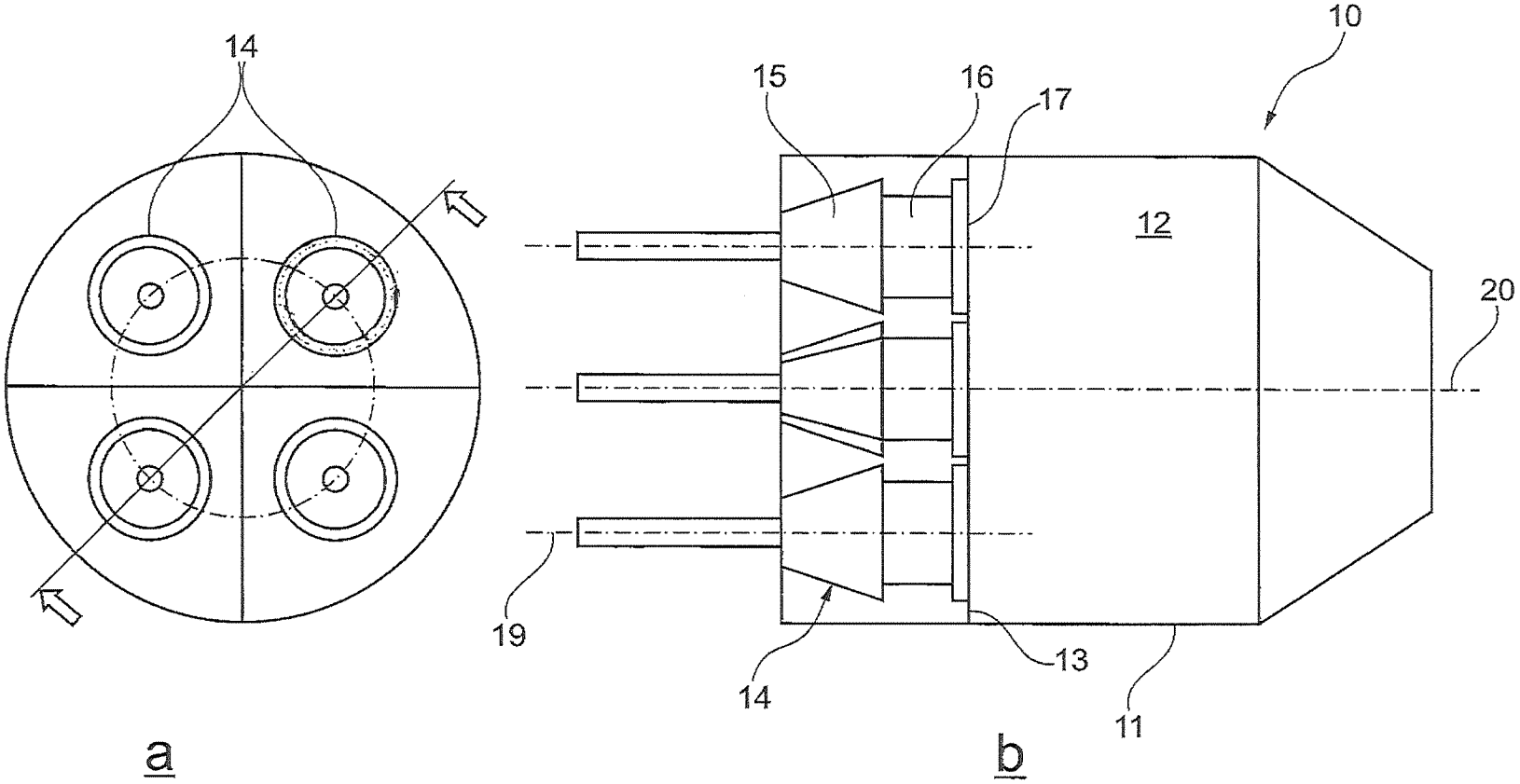
FIG. 1*a*, 1*b* show a schematic view of a first embodiment of a can-combustor in a top view (FIG. 1*a*) and in a sectional side view (FIG. 1 *b*)

With reference to FIGS. 1*a* and 1*b* a can-combustor for a gas turbine 10 with a first exemplary embodiment of the invention is schematically shown. It will be understood that this can-combustor 10 is typically combined with a number of additional similar or identical combustors arranged in an annular array in the gas turbine casing, each combustor supplying hot combustion gases to downstream turbine stages.

Each can-combustor 10 comprises a cylindrical casing 11 enclosing a combustion zone 12 for burning a mixture of fuel and combustion air. At an upstream end the combustion zone 12 is limited by a front panel 13. Four premixed burners 14, extending from the front panel 13 in an upstream direction, are attached to the front panel 13. At their burner exits 17 the burners are supported by the front panel 13. The burner supply the mixture of fuel and air into the combustion zone 12. All burners 14 are aligned parallel to each other and parallel to the central combustor axis 20. The burner exits 17 are flush with the front panel 13.

The premixed burners 14 are burners of the types as described in EP 321809 or EP 704657, for example. These types of burners are characterized by conical swirl generators, assembled from at least two hollow part-cone segments with a mutual offset, forming the axially extending air inlet slots between the individual segments for tangentially supplying combustion air into the swirl generator 15. The air inlet slots are equipped with nozzles for injecting gaseous and/or liquid fuels into the air flow. Exemplary embodiments of such burners comprise two, four or eight air inlet slots.

According to an embodiment of this invention one or more burners 14 are equipped with a lance, aligned parallel to the central axis 19, for injecting additional fuel and/or air into the fuel/air flow. Particularly this lance can be used for supplying pilot fuel and, as an option, additional premix fuel.

Said plurality of fuel nozzles of every individual burner 14 may include different groups of fuel nozzles, being controlled independently of each other. By this means the premixed burners 14 may dispose of three or even more fuel stages, e.g. of one pilot stage and two premix stages.

Downstream of the swirl generator 15 follows a mixing tube 16 for homogeneously mixing the fuel and the air. At an outlet end 17 of the premixed burners 14 a homogeneous mixture of fuel and combustion air is supplied into the combustion zone 12. The ignition of the fuel/air-mixture starts downstream of the burner outlet end 17. By a vortex breakdown and the formation of a backflow zone the flame is stabilized in the region downstream of the burner outlet end 17.

The length of the mixing tube 16 is selected so that an adequate mixing quality for all types of relevant fuels is obtained. According to the embodiment, shown in FIG. 1*b*, the four burners 14 posses identically configured swirl generators 15 and mixing tubes 16, i.e. all swirl generators 15 have the same number of air inlet slots and all mixing tubes 16 have the same length and the same diameter.

In the mixing tube 16 the axial-velocity profile has a maximum in the area of its central axis and thereby preventing flashback in this region. The axial velocity decreases toward the wall. In order to also prevent flashback in that area, various known measures may be taken, e.g. to rise the overall flow velocity by a respective dimensioning of the diameter and/or length of the mixing tube 16.

In particular, said premixed burners can be operated with liquid and/or gaseous fuels of all kinds. Thus, it is readily possible to provide different fuels or fuel qualities to the individual cans 10 of a gas turbine.

Figure 5:
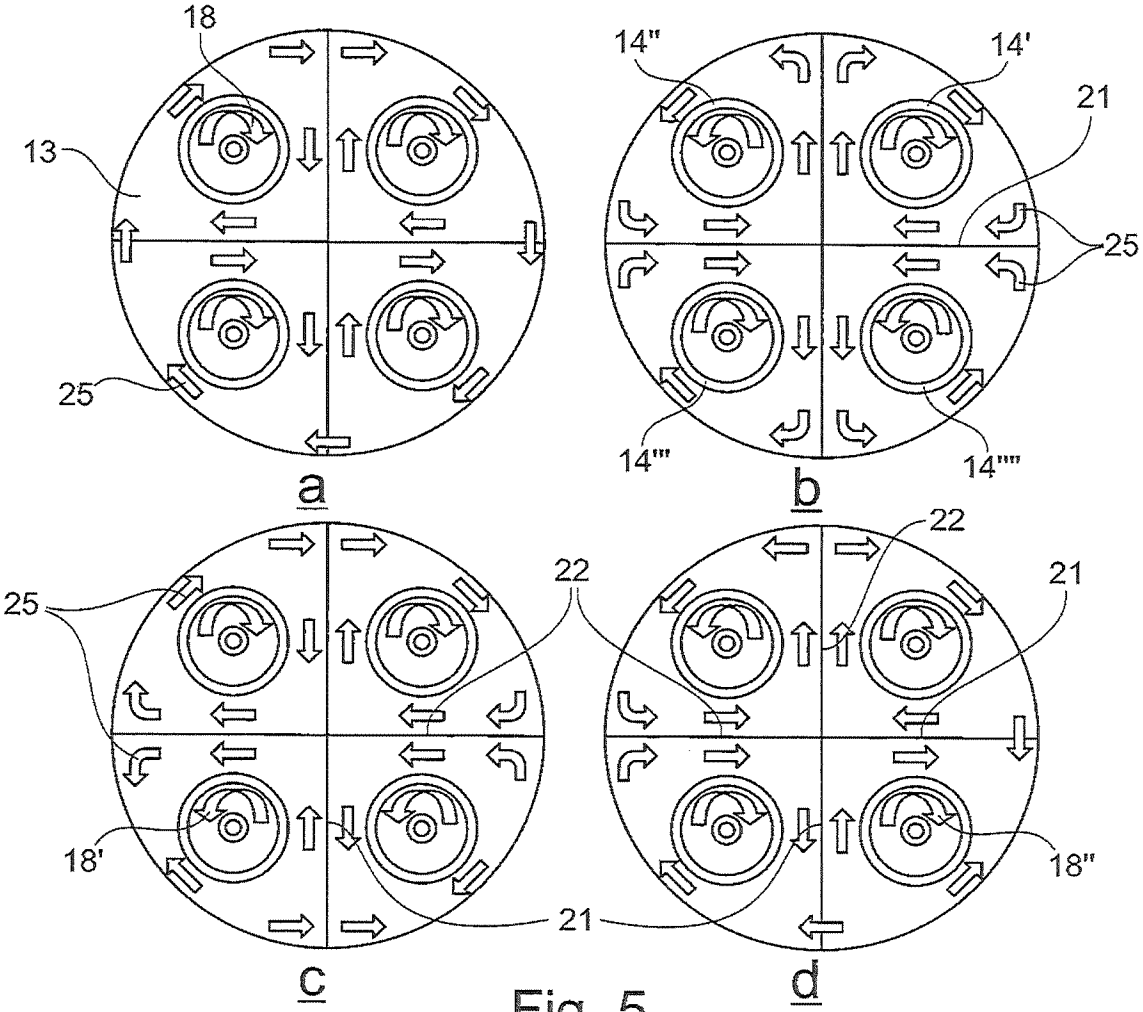
FIG. 5*a*-5*d* show a top view onto a front panel with four installed burners with different senses of swirl rotation.

With reference to FIG. 1*a* and 5*a* a top view of a front panel 13 is schematically shown. Four premixed burners 14 are mounted on the front panel 13. It is remarkable that a central burner according to conventional can combustors does not exist. The four premixed burners 14 are symmetrically positioned on the same perimeter in four identical 90° sectors of the front panel 13. All burners 14 have the same sense of swirl rotation, i.e. all burners generate either a clockwise swirl or an anti-clockwise swirl. In the embodiment, as shown in FIG. 5*a*, all burners 14 generate a clock-wise swirl flow 18. As a consequence, the directions of the swirl flows 18 of adjacent burners 14', 14", 14''', 14'''' are in the opposite direction in a tangency boundary area 21 with increased turbulences and increased shear forces and with more heat and mass transfer in this area 21. Downstream a secondary radially outer swirl flow 25 is forming.

FIGS. 5*b*, 5*c* and 5*d* represent alternative embodiments with two groups of burners 14', 14", 14''', 14'''', a first group configured to generate a swirl flow in a first direction, e.g. a clockwise sense of flow, and a second group of burners to generate a swirl flow in opposite direction, e.g. an anti-clockwise sense of flow.

According to the embodiment of FIG. 5*b* adjacent burners 14 generate swirl flows 18 of opposite senses of rotation, whereas diagonally opposing burners 14'-14''', 14"-14'''' have the same sense of rotation. In a tangency boundary area 22 between adjacent burners 14 the flows circulate in the same direction, the relative velocities of the adjacent swirls in this area are close to zero with low shear forces and low turbulences in this area 22 with the effect of a significantly reduced heat and mass transfer in this region.

The FIGS. 5*c* and 5*d* disclose additional configurations of burners with different swirl senses in a can combustor 10 with four burners 14', 14", 14''', 14'''' according to the invention. FIG. 5*c* shows a configuration with diagonally opposing burners having different senses of swirl rotation and FIG. 5*d* shows a configuration with three burners 14', 14''', 14'''' generating a clockwise swirl flow 18 and one burner 14" generating an anti-clockwise swirl flow 18.

The modifications of flow patterns creating co- and counter-flow at the aerodynamic interface between two adjacent burners 14', 14", 14''' or 14'''' and resulting specific secondary flow patterns 25 effect different combustion behaviors of the respectively equipped cans 10 and may be used for optimum stability of the combustion and for low emissions.

Figure 2:
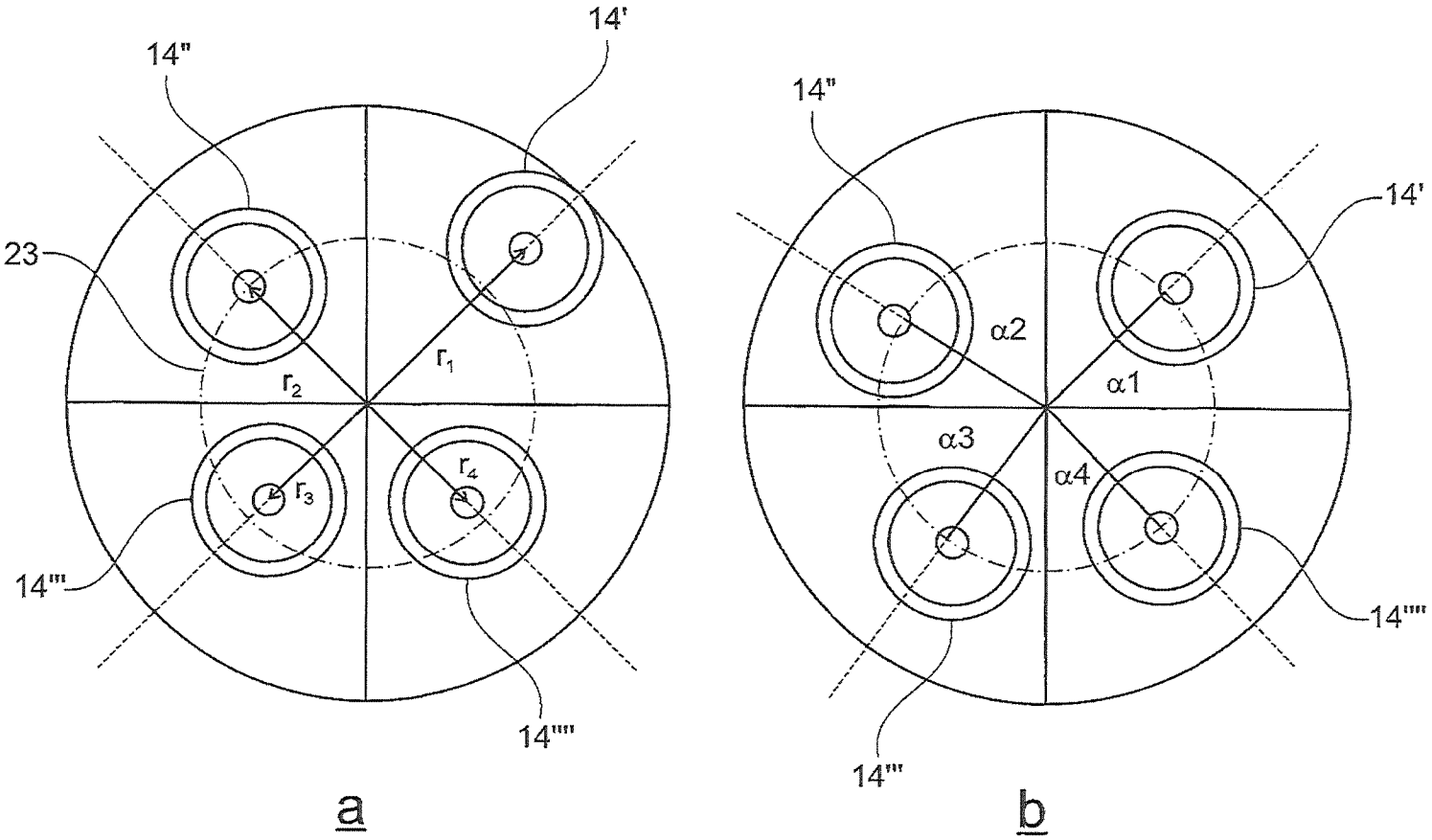
FIG. 2*a*, 2*b* show a top view on a front panel with four burners, attached to the front panel on different perimeters (FIG. 2*a*) or on different azimuthal angles (FIG. 2*b*)

Another embodiment of a can combustor according to the invention is disclosed in FIG. 2*a*. The four burners 14', 14", 14''', 14'''' with one burner in each of the four 90° sectors are positioned on different radial distances from the centre of the can 10.

The radial distance $r_1$ of at least one burner 14' differs from the radial distance $r_2$, $r_3$ or $r_4$ of at least one other burner 14", 14''' or 14'''', wherein the radial distances $r_1$, $r_2$, $r_3$, $r_4$ are defined as the distances between the longitudinal axis 20 of the can 10 and the longitudinal axis 19 of the respective burner 14', 14", 14''', 14''''. Concretely FIG. 2*a* shows an embodiment with four burners each of them positioned in the front panel 13 on a different distance from the central axis of the can combustor 10: $r_1 \neq r_2 \neq r_3 \neq r_4$.

FIG. 2*b* discloses a further embodiment of the invention. At least one burner 14' of the four burners 14 with one burner in each of the four equal 90° sectors is positioned at a different azimuthal angle $\alpha_1$, $\alpha_2$, $\alpha_3$ or $\alpha_4$ in its respective 90° sector in relation to the position of at least one other burner 14", 14''' or 14''''.

Figure 7:
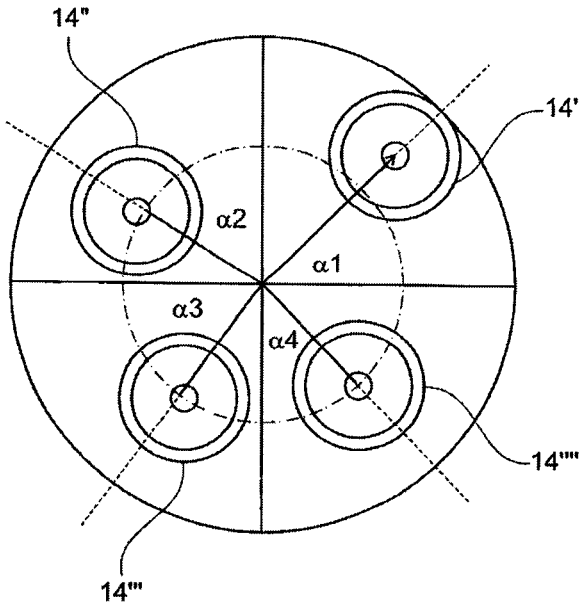
FIG. 7 shows a top view on a front panel with four burners, attached to the front panel on different perimeters and on different azimuthal angles.

FIG. 7 discloses a top view on a front panel with four burners, attached to the front panel on different perimeters and on different azimuthal angles.

The avoidance of symmetry in the can combustor 10 leads to less excitation of azimuthal instability modes within the can 10.

Figure 3:
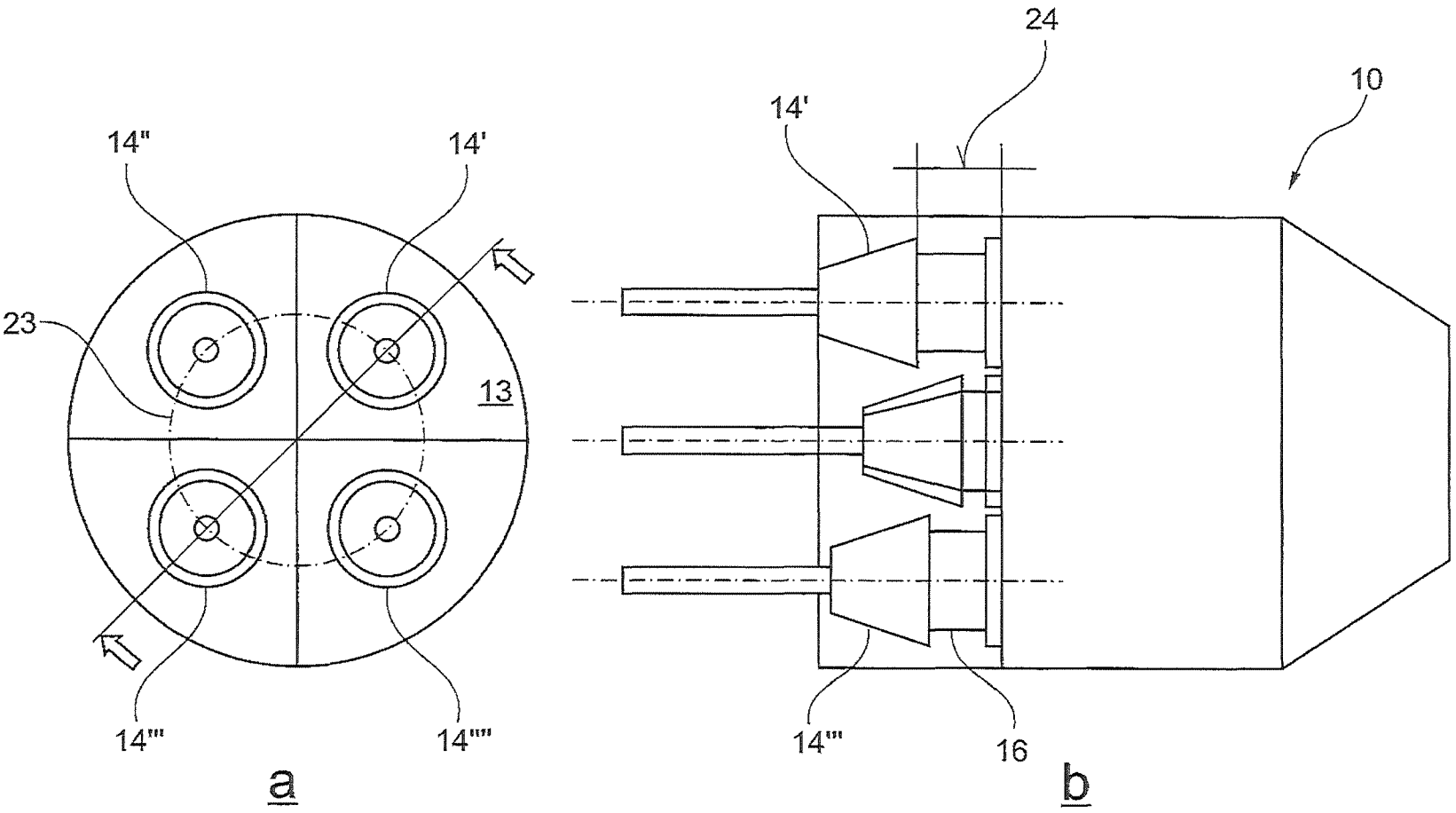
FIG. 3*a*, 3*b* show a schematic view of a can-combustor with burners of different lengths of the mixing tube in top view (FIG. 3*a*) and side view (FIG. 3*b*)

FIGS. 3*a* and 3*b* schematically show in another embodiment a can combustor 10 with four burners 14, wherein at least one, up to all burners 14 are equipped with mixing tubes 16 of different length. From the side view of FIG. 3*b* can be seen that any burner 14', 14" and 14''' has a different mixing tube length 24 in relation to the mixing tube length of another burner 14. Different lengths 24 of the mixing tubes 16 of a premixed burner 14 effect different characteristic mixing times of the fuel/air mixture and consequently different durations of time between the moment, when the fuel is injected into the burner and that moment, when it reaches the flame front. Different mixing times are an effective means to decouple the interaction between the fuel supply and pressure parameters in the combustion zone and thus to reduce thermo-acoustic oscillations in the can combustor.

Figure 4:
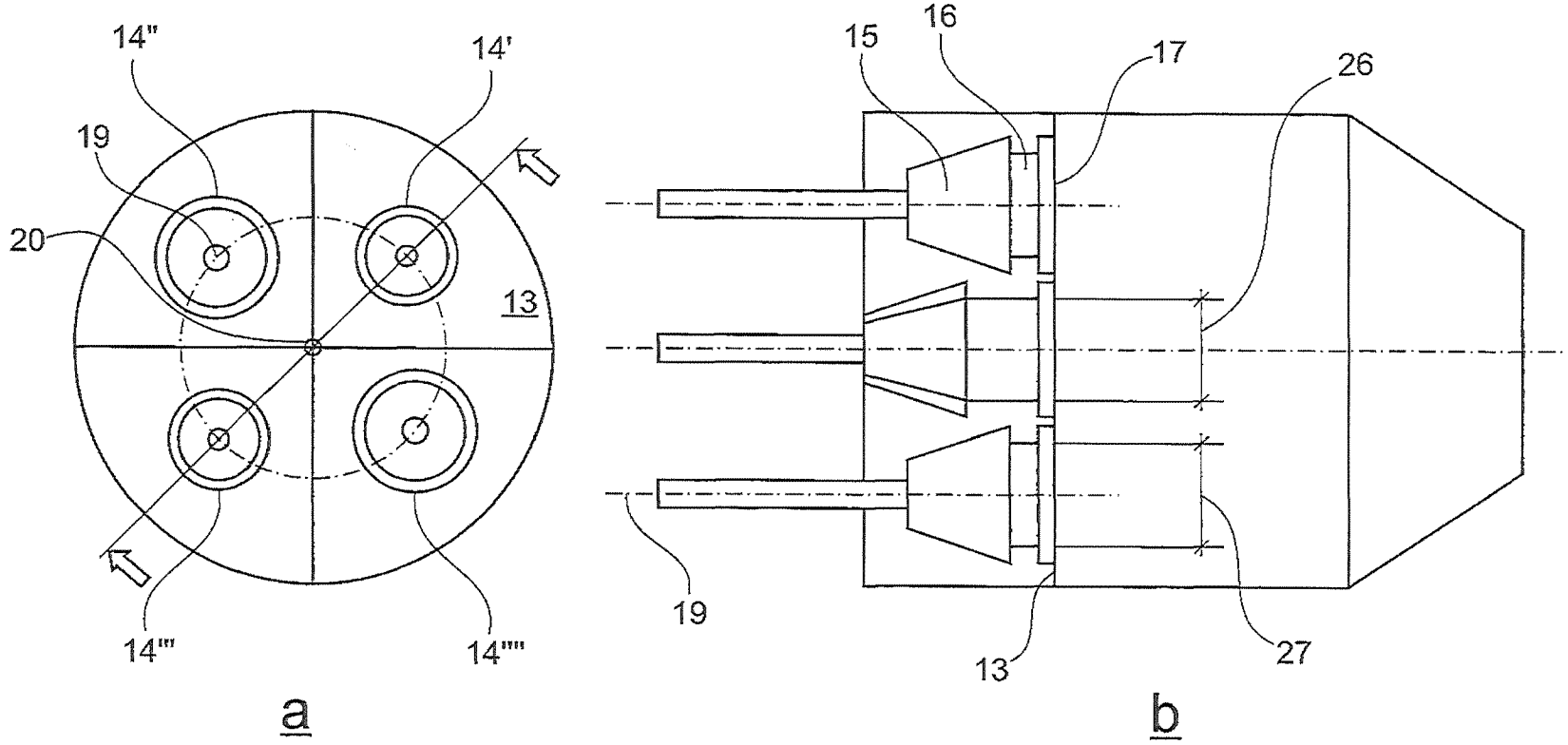
FIG. 4*a*, 4*b* show a schematic view of a can-combustor with burners of different dimensions.

Another embodiment of the inventive can combustor 10 is disclosed in FIGS. 4*a* and 4*b*. According to this embodiment the burners 14 within the can 10 differ in their dimension by being up-scaled or down-scaled from a nominal size. In particular, the burners 14', 14", 14''', 14'''' may differ in a diameter and/or a length of the swirl generator 15 and/or the mixing tube 16. FIGS. 4*a* and 4*b* schematically show a can combustor 10 with four burners 14', 14", 14''', 14''''. All burners 14 are positioned at the same distance from the central axis 20 of the can 10; the central axis 19 of every individual burner 14', 14", 14''', 14'''' is arranged on the same perimeter circle 23. Two groups of burners can be identified: burners 14' and 14''' and burners 14" and 14''''. The two groups differ in the dimensions of the length and the diameter of the swirl generator 15 and the mixing tube 16 and in the burner exit 17 diameter 27, wherein diametrically opposite burners 14' and 14''' or 14" and 14'''' are equally dimensioned.

According to another preferred embodiment at least one burner 14', 14", 14''' or 14'''' is equipped with a smaller diameter than the other burners 14', 14", 14''', 14'''' with the effect of less flow-through. This burner with the less flow-through can be operated with a higher pilot ratio with the effect of a reduction of the combustor dynamics and thus a stabilization of the combustion in the can 10.

According to another embodiment of the invention the individual burners 14', 14", 14''', 14'''' generate swirls 18 of different intensity. Preferably this measure may be accompanied by any of the before-mentioned measures of different dimensioning of individual burner parts or of the creation of differing flow patterns of co- and counterflow within the can combustor 10. Variations in the swirl intensity can be influenced by the dimension of the burner parts, but particularly differing intensities of the swirl flow (high swirl variants or low swirl variants) are realized by the dimension of the air inlet slots of the swirl generator 15 of an individual burner 14. The advantage is again in the higher inhomogeneity of the flow conditions in the combustor and hence in possible lower combustor dynamics.

Figure 6:
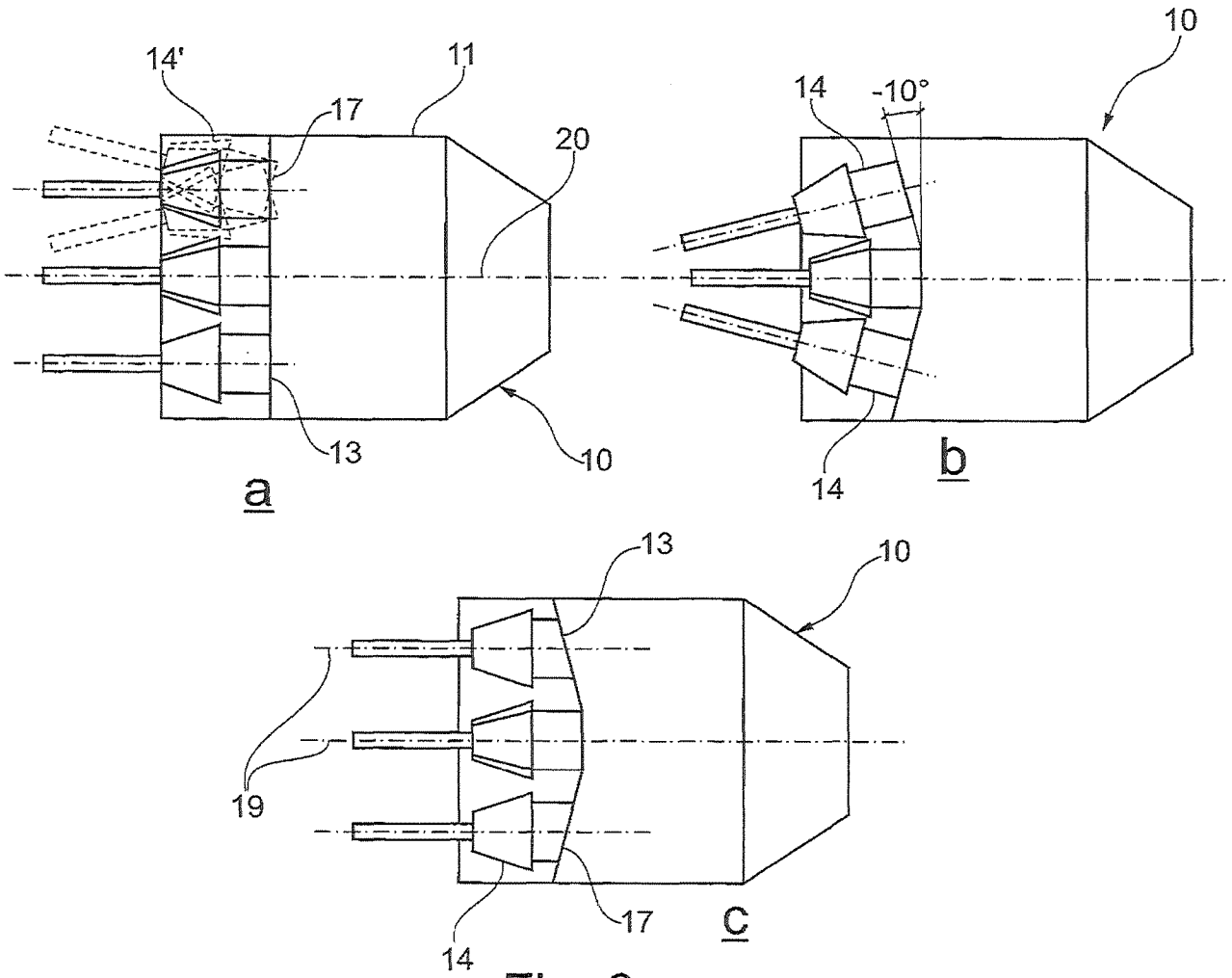
FIG. 6*a*-6*c* show side views of a can-combustor with a planar or a conical front panel.

With reference to FIGS. 6*a*, 6*b* and 6*c* three principle arrangements of the burners 14 in the front panel 13 of the can 10 are schematically shown.

The can 10 according to FIG. 6*a* comprises a cylindrical housing 11 with a planar front panel 13 at its upstream end. The planar front panel 13 is arranged essentially orthogonally to the central axis 20 of the can combustor 10. Four burners 14 are attached to this front panel 13. The longitudinal axes 19 of all burners 14 are parallel to each other and are parallel to the central axis 20 of the can 10. FIG. 6*a* discloses as an alternative to arrange at least one burner 14' in a different direction. The longitudinal axis 19 of said at least one burner 14' or of more burners 14", 14''' and/or 14'''' may be inclined up to ±10° relating to the central axis 20 of the can combustor 10. In this case, as a preferred embodiment, the respective burner exit(s) 17 is/are cut off flush with the front panel 13. As a consequence, the inclined burners possess an oval burner exit 17.

In an alternative embodiment, as disclosed in FIG. 6*b*, the planar front panel 13 is replaced by a conical front panel 13, whereby the inclination angle of the conical front panel corresponds to the inclination angle of the burner axes 19. As a consequence, the plane of the burner exit 17 is parallel to the front panel 13.

In a third alternative embodiment according to FIG. 6*c* a can combustor 10 is equipped with a conically formed front panel 13 at its upstream end. Four burners 14 with parallel longitudinal axes 19 to each other and to the central axis 20 of the can 10 are attached to said front panel 13. Two options to attach the burners 14 to the front panel 13 are evident. The burners 14 can be fixed to front panel 13 in such a way that the burner exits 17 partly or completely protrude into the combustion zone 12 or alternatively the burner exits 17 are slanted to an ellipsoid outlet in such a way that they are flush against the conical front panel 13.

Alternatively to the above-disclosed conical shape the front panel 13 may be made of a segmented structure, based on a number of flat segments, preferably four segments, of an essentially triangular form.

The invention claimed is:

1. A can combustor for a can-annular combustor arrangement in a gas turbine, the can combustor comprising:

an essentially cylindrical casing with an axially upstream front panel and an axially downstream outlet end;

four premixed burners extending in an upstream direction from said front panel with one premixed burner positioned in each individual 90° sector of the front panel, each premixed burner having a burner exit and supported by the front panel, for supplying a fuel/air mixture into a combustion zone inside the casing, each burner having a conical swirl generator and a mixing tube to induce a swirl flow of said fuel/air mixture, each premixed burner is arranged on the front panel on a different perimeter and on a different azimuthal angle ($\alpha_1$, $\alpha_2$, $\alpha_3$, $\alpha_4$) within its respective 90° sector in relation to each burner, wherein an alignment of a central longitudinal axis of each premixed burner, attached to the front panel, differs from an alignment of a central longitudinal axis of each other premixed burner in a radial and azimuthal direction within its respective 90° sector and all burners have identically dimensioned swirl generators and mixing tubes.

2. The can combustor according to claim 1, wherein each of said conical swirl generators comprises at least two axially extending air inlet slots.

3. The can combustor according to claim 2, wherein the conical swirl generator of at least one burner comprises at least four axially extending air inlet slots.

4. The can combustor according to claim 3, wherein the conical swirl generator of at least one burner comprises eight axially extending air inlet slots.

5. The can combustor according to claim 1, wherein at least one burner is equipped with a lance, aligned parallel to the central longitudinal burner axis, for injecting additional fuel either into the swirl generator or the mixing tube or into the combustion zone.

6. The can combustor according to claim 1, wherein at least one burner has a multi-stage fuel supply.

7. The can combustor according to claim 6, wherein the premixed burners have up to three fuel stages, namely one or two premix stages and one pilot stage.

8. The can combustor according to claim 1, wherein the central longitudinal axes of all premixed burners, attached to the front panel, are parallel to each other.

9. The can combustor according to claim 8, wherein the central longitudinal axes of the premixed burners are parallel to a central combustor axis.

10. The can combustor according to claim 1, wherein the central longitudinal axis of said at least one burner is inclined up to ±10° in relation to a central combustor axis.

11. The can combustor according to claim 10, wherein all burners, attached to the front panel, have the same inclination angle in relation to a central axis of the can.

12. The can combustor according to claim 1, wherein the central longitudinal axis of said at least one burner is inclined up to ±20° in relation to its diagonally opposite burner.

13. The can combustor according to claim 1, wherein all installed premixed burners induce a swirl with the same sense of rotation, e.g. a clockwise swirl.

14. The can combustor according to claim 1, wherein the installed premixed burners comprise two burner-groups, wherein the first group induces a swirl flow with a clockwise sense of rotation and the second group induces a swirl flow with an anti-clockwise sense of rotation.

15. The can combustor according to claim 14, wherein diametrically opposed burners induce a swirl with the same sense of rotation.

16. The can combustor according to claim 14, wherein two adjacent burners induce a swirl with the same sense of rotation.

17. The can combustor according to claim 14, wherein one burner induces a swirl with a sense of rotation that differs from the swirl direction of the other burners.

18. The can combustor according to claim 1, wherein the front panel is a substantially circular planar plate, arranged orthogonally to a central axis of the can, wherein the premixed burners extend upstream from said planar plate and the burner exits are supported by said planar front plate.

19. The can combustor according to claim 18, wherein the mixing tubes of the burners pass the front panel and the burner exits protrude into the combustion zone.

20. The can combustor according to claim 18, wherein the burner exits are flush with the front panel.

21. The can combustor according to claim 1, wherein the front panel is formed as a cone and is conical, wherein the burners are attached to a lateral area of this cone.

22. The can combustor according to claim 21, wherein the mixing tubes of the burners pass the conical front panel and the burner exits protrude, at least partially, into the combustion zone.

23. The can combustor according to claim 21, wherein the burner exits are flush with the conical front panel.

24. The can combustor according to claim 1, wherein the front panel is formed from a number of segments of essentially triangular shape, and the number of these segments is equal to the number of the burners, attached to the front panel.

25. The can combustor according to claim 1, wherein at least one of the burners induces a swirl flow with a clockwise sense of rotation and at least one of the burners induces a swirl flow with an anti-clockwise sense of rotation.

* * * * *